US007896185B2

(12) United States Patent
Campbell et al.

(10) Patent No.: US 7,896,185 B2
(45) Date of Patent: Mar. 1, 2011

(54) PLASTIC CONTAINER HAVING GASKETLESS SEAL

(75) Inventors: Newton K. Campbell, Troy, AL (US); Kenneth J. Reed, Troy, AL (US); Michael N. Miller, Milwaukee, WI (US); David G. Packard, Adell, WI (US)

(73) Assignee: KW Plastics, Troy, AL (US)

( * ) Notice: Subject to any disclaimer, the term of this patent is extended or adjusted under 35 U.S.C. 154(b) by 899 days.

(21) Appl. No.: 11/682,454

(22) Filed: Mar. 6, 2007

(65) Prior Publication Data

US 2008/0217338 A1 Sep. 11, 2008

(51) Int. Cl.

| | |
|---|---|
| ***B65D 53/00*** | (2006.01) |
| ***B65D 55/06*** | (2006.01) |
| ***B65D 1/42*** | (2006.01) |
| ***B65D 39/00*** | (2006.01) |

(52) U.S. Cl. ..... 220/276; 220/780; 220/790; 220/658; 220/659

(58) Field of Classification Search ..... 220/790, 220/782, 780, 658, 659, 675, 669, 276, 802; 215/344, 354, DIG. 1

See application file for complete search history.

(56) References Cited

U.S. PATENT DOCUMENTS

| | | | | |
|---|---|---|---|---|
| 3,664,544 | A * | 5/1972 | Hammes | 220/320 |
| 3,688,942 | A * | 9/1972 | Mitchell et al. | 220/784 |
| 3,811,597 | A | 5/1974 | Frankenberg et al. | |
| 4,209,107 | A | 6/1980 | Crisci | |
| 4,296,871 | A | 10/1981 | Andersson | |
| 4,349,119 | A | 9/1982 | Letica | |
| 4,367,821 | A | 1/1983 | Holt | |
| 4,457,447 | A | 7/1984 | Kirkis | |
| 4,735,337 | A | 4/1988 | Von Holdt | |
| 4,799,603 | A | 1/1989 | Dudzik | |
| 5,027,973 | A | 7/1991 | Drogos | |
| 5,167,344 | A | 12/1992 | Van Schilt | |
| 5,238,135 | A | 8/1993 | Landis | |
| 5,294,015 | A | 3/1994 | Landis | |
| 5,437,386 | A | 8/1995 | Von Holdt | |

(Continued)

FOREIGN PATENT DOCUMENTS

FR 2705857 A1 12/1994

(Continued)

OTHER PUBLICATIONS

European Search Report dated Jun. 9, 2008.

*Primary Examiner* — Robin Hylton
(74) *Attorney, Agent, or Firm* — Andrus, Sceales, Starke & Sawall, LLP

(57) ABSTRACT

A molded plastic container, such as a five gallon pail, that includes a lid and main body that are selectively attachable to each other without a resilient gasket. The main body of the plastic container includes a flexible sealing finger formed along the top rim of the main body. The flexible sealing finger is received within a sealing chamber formed as part of the rim. The sealing chamber is defined by a gland seal such that when the lid is attached to the main body, both the flexible finger and the gland seal can deflect to create multiple sealing points between the flexible sealing finger and the sealing chamber. A latch ring is formed on the outer surface of the main body and engages a locking tab formed on the lid to hold the flexible finger in the sealing chamber.

20 Claims, 4 Drawing Sheets

U.S. PATENT DOCUMENTS 5,730,309 A * 3/1998 Jiradejnunt et al. ..... 220/276
5,743,425 A 4/1998 Ellis
5,785,203 A 7/1998 Arschinoff et al.
5,913,446 A 6/1999 von Holdt, Sr. et al.
6,021,917 A 2/2000 Lovell et al.
6,098,833 A 8/2000 von Holdt, Sr. et al.
6,257,438 B1 7/2001 von Holdt, Jr.
6,543,635 B2 4/2003 Ciccone
6,619,498 B2 9/2003 von Holdt, Jr.
6,688,483 B2 2/2004 Davis
6,708,839 B2 3/2004 Diesterbeck
6,779,676 B2 8/2004 Ciccone
6,845,877 B2 1/2005 Diesterbeck
6,880,716 B2 4/2005 Gottainer et al.
6,959,829 B2 11/2005 Crider et al.
6,964,348 B2 11/2005 Breimon et al.
7,086,551 B2 8/2006 von Holdt, Jr.
7,090,088 B2 8/2006 von Holdt, Jr.
2002/0063134 A1 5/2002 von Holdt, Sr. et al.
2002/0148846 A1 10/2002 Luburic
2003/0071043 A1 4/2003 Davis
2003/0168460 A1 9/2003 von Holdt, Sr. et al.
2004/0112906 A1 6/2004 von Holdt, Jr.
2004/0195251 A1 10/2004 von Holdt, Jr.
2004/0195252 A1 10/2004 von Holdt, Sr. et al.
2006/0043100 A1* 3/2006 Johnson et al. ..... 220/839
2006/0243735 A1* 11/2006 Kline et al. ..... 220/780

FOREIGN PATENT DOCUMENTS

GB 2085415 A 4/1982

* cited by examiner

PLASTIC CONTAINER HAVING GASKETLESS SEAL

BACKGROUND OF THE INVENTION

The present invention generally relates to a cylindrical container having an open end sealed by a removable and resealable lid. More specifically, the present invention relates to a plastic cylindrical container and lid assembly that form a generally liquid and vapor tight seal without the use of a resilient gasket.

Presently, many designs for plastic buckets or containers that include a removable and resealable lid exist for the storage of liquids, such as paint or other chemical compounds. Many of these container and lid assemblies are formed in a conventional five-gallon size, which has become an accepted and common container size for the storage and delivery of liquid materials, such as paint.

Since many of these plastic containers store liquids during transport and for extended durations prior to use or following use, it is important that the lid and container form a liquid and vapor tight seal to prevent leakage during shipment and to prevent or limit the contents of the container from being affected by the ambient atmosphere. In a very common prior lid and container assembly, a resilient gasket is positioned between the container lid and the container body. When the lid is attached to the body, the gasket is compressed to create a liquid and vapor seal between the container body and the lid.

Although the use of a resilient gasket between the container body and lid has proven to be an effective way to create both a vapor and liquid seal, the inclusion of the resilient gasket within the container assembly requires additional processing steps, thereby increasing the cost and complexity of creating the plastic container. Therefore, a need exists for a plastic container assembly that provides a liquid and vapor seal between the container main body and the lid without requiring a gasket. Further, a need exists for a plastic container assembly that can be molded and formed using conventional techniques.

SUMMARY OF THE INVENTION

The present invention relates to a plastic cylindrical container, such as a five gallon pail, that is formed by injection molding and includes a lid that is removably attachable to a main body to provide a liquid and vapor tight seal without the use of a gasket.

The cylindrical main body includes an open top end that is defined by a circumferential lip. The circumferential lip includes a flexible sealing finger that has a width extending between a first sealing protrusion and a second sealing protrusion. The flexible sealing finger is pivotally integral to the container sidewall by a flexible neck such that the sealing finger can flex during attachment of the lid to the main body. The main body of the plastic container includes a latch ring extending outward from an outer surface of the container sidewall to hold the lid onto the main body.

The plastic container further includes a lid that is adapted to be received on the open top end of the main body. The lid includes a top wall connected to a circumferential inner sidewall. The inner sidewall is joined to an outer sidewall by a horizontal connector portion that extends transverse to both the outer sidewall and the inner sidewall. A gland seal extends from the connector portion at a location between the inner sidewall and the outer sidewall such that the gland seal and the inner sidewall define a sealing chamber. The width of the sealing chamber between the gland seal and the inner sidewall is slightly less than the width of the flexible sealing finger formed as part of the main body in order to create sufficient contact pressure for a liquid and vapor seal.

The outer sidewall of the lid is spaced from the gland seal to define a flexing chamber. The first end of the outer sidewall includes a locking tab. When the lid is installed on the main body, the locking tab of the outer sidewall engages the latch ring to retain the lid on the main body and hold the flexible sealing finger within the sealing chamber.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
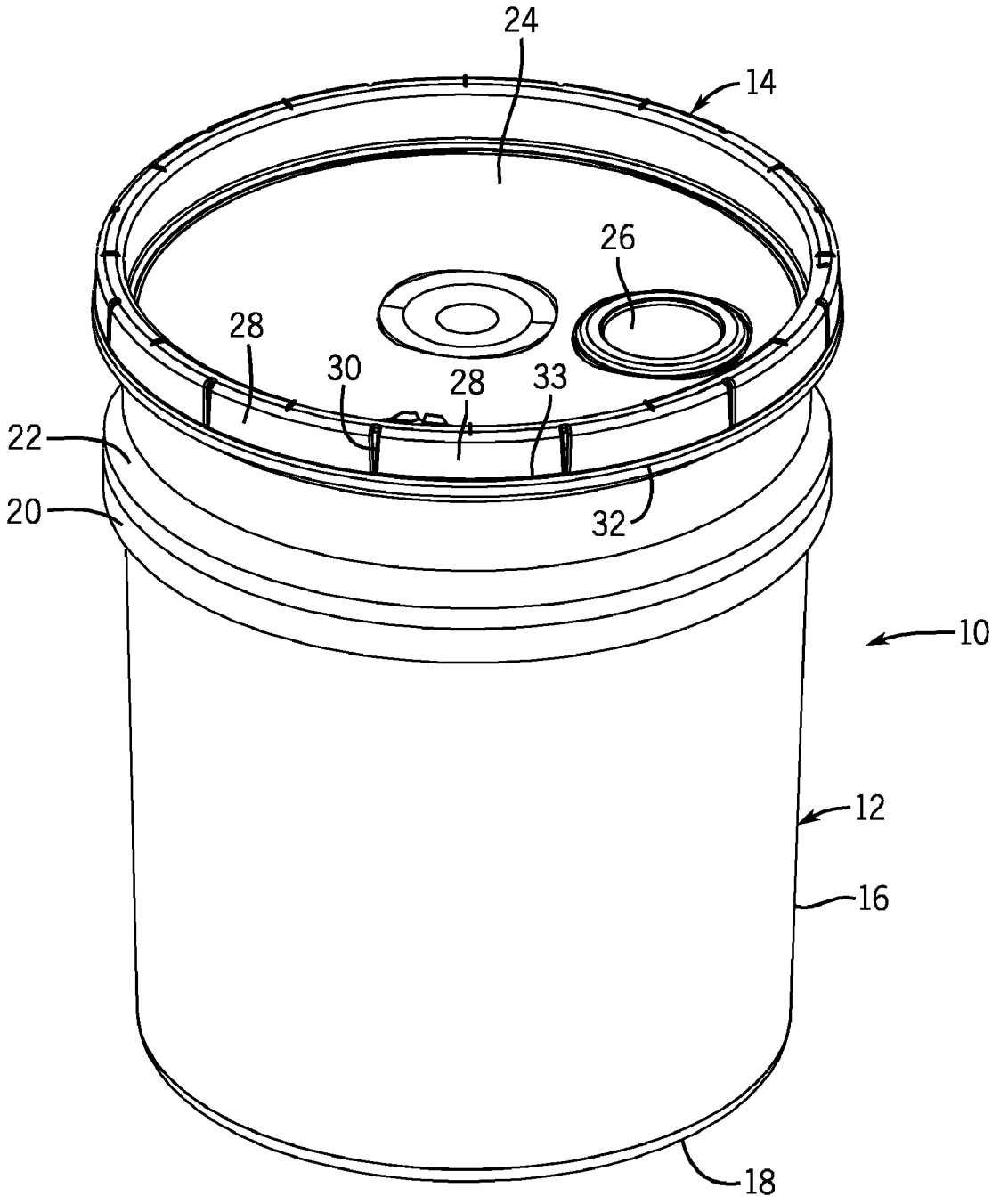
FIG. 1 is a perspective view of a cylindrical plastic container including a container main body and a lid constructed in accordance with the present invention.
Figure 2:
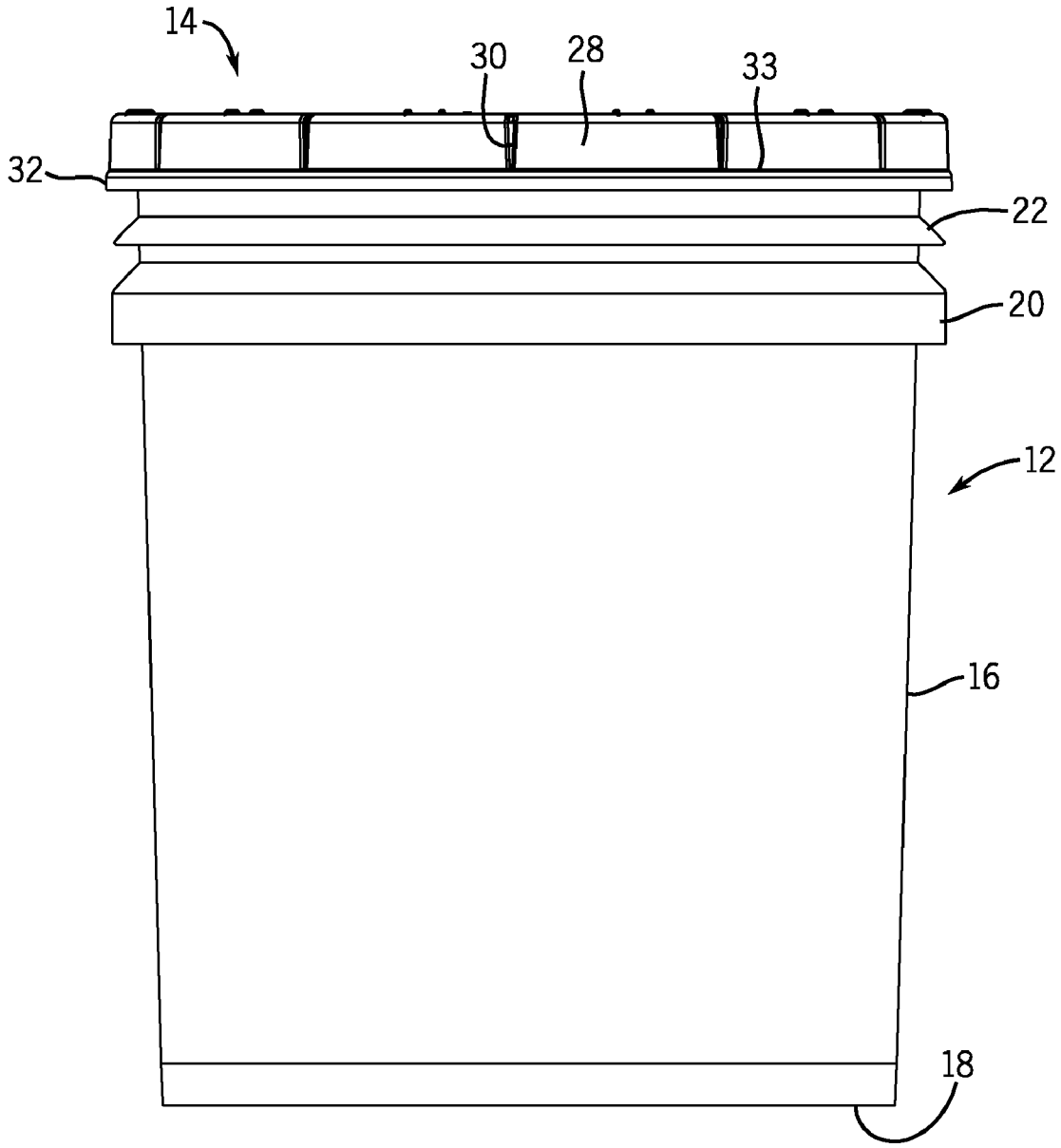
FIG. 2 is a front view of the plastic container.

FIG. 1 illustrates a plastic container 10. In the embodiment illustrated in FIG. 1, the plastic container 10 has a capacity of five gallons, although other sizes are contemplated as being within the scope of the present invention. The plastic container 10 includes a cylindrical main body that receives a lid 14. The main body 12 includes a cylindrical container sidewall 16 that is joined at its bottom end to a bottom wall 18. In the embodiment shown in FIG. 2, the container sidewall 16 includes a first satellite ring 20 and a second satellite ring 22 that provides additional support for the container wall 16.

The lid 14 shown in FIG. 1 is sized to be received on the container main body 12 and includes a top wall 24 that extends across the open interior of the container 10 defined by the main body 12. The top wall 24 defines a generally planar top surface that includes an optional opening 26 for adding to the contents of the assembly (pigments, etc.) or for pouring the contents out of the container without removal of the lid 14.

The lid 14 includes a series of separate locking sections 28 spaced along the outer circumference of the lid. Each of the locking sections 28 are separated by an open groove 30 that allows each of the locking sections 28 to be moved independently from the other locking sections 28. As illustrated in FIG. 1, a tear strip 32 joins the bottom edge 33 of each of the locking sections 28 to restrict removal of the lid 14 from the main body 12. When the container 10 is opened for the first time, the tear strip 32 is removed from the lid 14 to permit the locking sections 28 to be separately lifted to permit removal of the lid 14 from the main body 12. Once the tear strip 32 has been removed, the lid 14 can be repeatedly removed and reattached to the main body 12, as is conventional.

Figure 3:
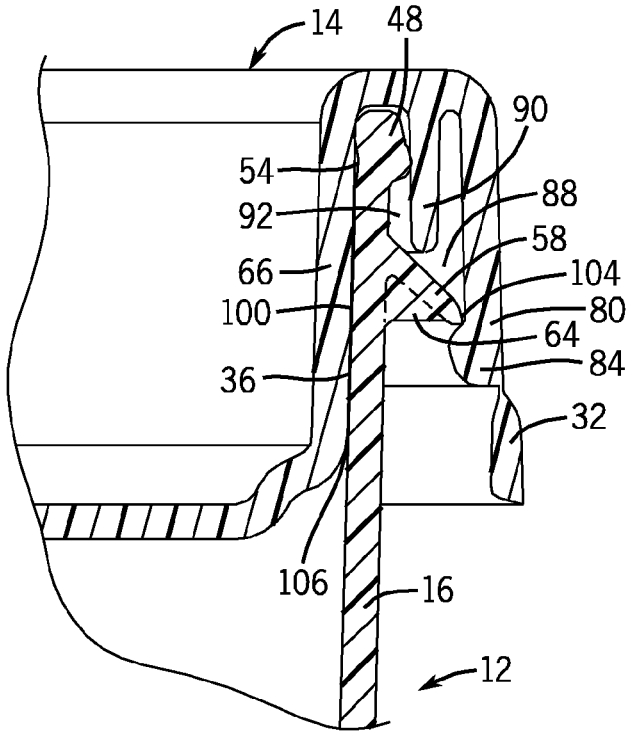
FIG. 3 is a section view illustrating the interaction between the main body of the container and the lid.
Figure 4:
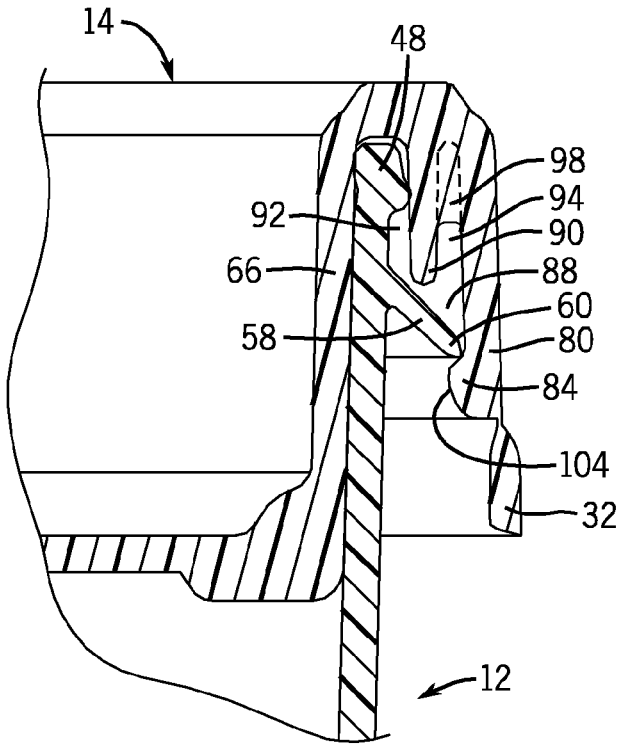
FIG. 4 is a view similar to FIG. 3 illustrating one of the strengthening ribs contained within the lid.
Figure 5:
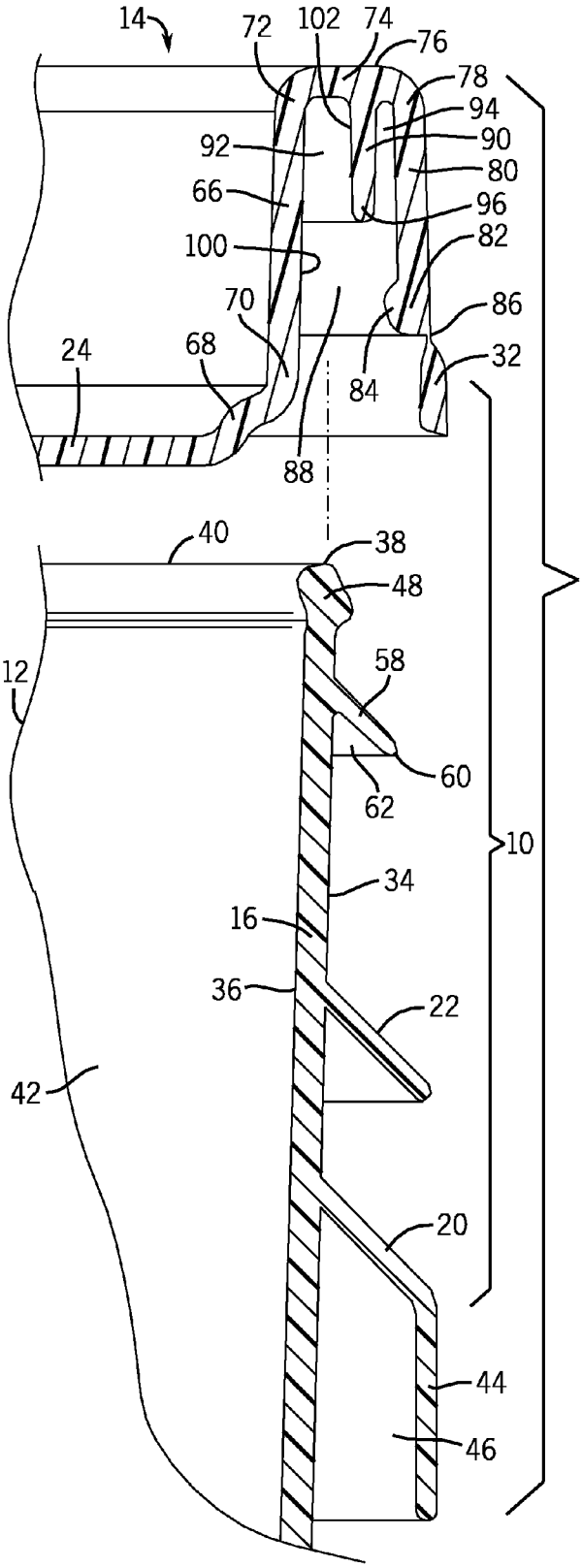
FIG. 5 is an exploded, section view illustrating the lid and main body of the container.

FIGS. 3-5 illustrate the detailed configuration of both the lid 14 and the main body 12, both before attachment of the lid 14 to the main body 12 and after the lid 14 has been securely attached. Referring first to FIG. 5, the container sidewall 16 is a generally cylindrical element having an outer surface 34 and an inner surface 36. The container sidewall 16 extends from the bottom wall (FIG. 1) to a top lip 38. The top lip 38 defines an open top end 40 of the main body 12, through which liquid can be removed and supplied into the open interior 42 defined by the main body in addition to the opening 26. In the embodiment illustrated, both the first satellite ring 20 and the second satellite ring 22 extend at an angle from the outer surface 34. The first satellite ring 20 includes a vertical skirt 44 spaced from the outer surface 34 to define a finger cavity 46 that aids in lifting and carrying the plastic container 10. Although both of the first and second satellite rings 20, 22 are shown in the Figures, it is contemplated that either or both of these elements could be removed from the plastic container 10 or additional rings added.

Figure 6:
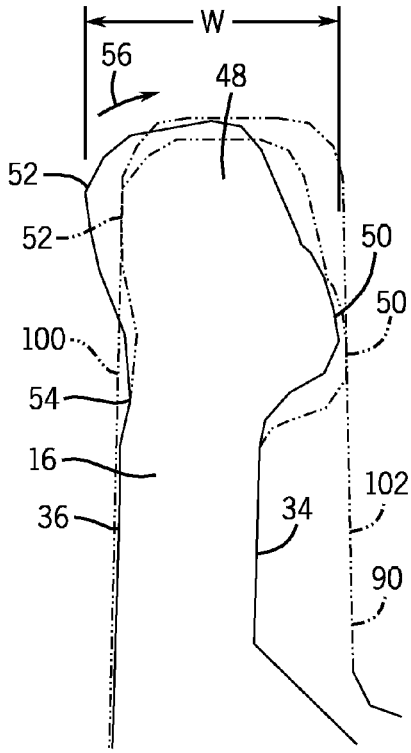
FIG. 6 is a magnified view of the flexible sealing finger formed on the top lip of the main body illustrating the pivoting motion of the sealing finger during attachment of the lid to the main body.

As illustrated in FIG. 5, the top end of the main body 12 includes a flexible sealing finger 48 integrally formed with the main body 12. The sealing finger 48 is integrally formed with the container wall 16 and is configured to flex and rotate as the lid 14 is attached to the main body 12. Referring now to FIG. 6, the flexible sealing finger 48 includes a first sealing protrusion 50 and a second sealing protrusion 52 that define the width W of the flexible sealing finger 48. As can be understood in FIG. 6, the first sealing protrusion 50 extends past the outer surface 34 while the second sealing protrusion 52 extends past the inner surface 36 of the container wall 16. The flexible finger 48 is attached to the container wall 16 at a flexible neck 54 having a reduced material thickness that allows the flexible finger 48 to pivot in the direction shown by arrow 56, as will be described in much greater detail below.

Referring back to FIG. 5, the main body 12 further includes an annular latch ring 58 that extends from the outer surface 34 of the container wall 16. The latch ring 58 is positioned slightly below the flexible sealing finger 48 and extends at approximately a 45° angle from the outer surface 34 to an outer end 60. The outer end 60 is spaced from the outer surface 34 to define an annular cavity 62. Referring now to FIG. 3, at spaced locations around the outer circumference of the container wall 16, the annular cavity 62 is filled with plastic material to define a support rib 64 to increase the stiffness and stability of the latch ring 58. In the embodiment of the invention illustrated, it is contemplated that the outer circumference includes support ribs 64 equally spaced around the outer circumference of the main body, although the number of support ribs 64 can vary based upon the design of the container.

In the embodiment illustrated in FIG. 5, the entire main body 12 is formed from a single, molded plastic component that includes all of the features previously described. The single, molded plastic main body 12 can be economically manufactured utilizing conventional molding techniques. However, it is contemplated that other materials besides plastic could be utilized to form the main body 12 while operating within the scope of the present invention.

As illustrated in FIG. 5, the lid 14 is sized to be received and retained by the main body 16 to close the open interior 42 of the main body 12 along the top end 40 defined by the top lip 38. The lid 14 includes the top wall 24 that is generally perpendicular to the container sidewall 16 and extends completely across the open interior 42 defined by the container sidewall 16. The top wall 24 is a generally horizontal member that is integrally formed with an inner sidewall 66 through a connecting web 68. The inner sidewall 66 is a generally vertical member that is joined at its first end 70 to the connecting web 68 and is joined at its second end 72 to a horizontal connecting portion 74. The connecting portion 74 defines an annular top edge 76 for the lid 14 and is joined to a second end 78 of an outer sidewall 80. The outer sidewall 80 extends vertically downward to a first end 82 that defines a locking tab 84. As previously described, the tear strip 32 is attached to the locking tab 84 formed on the first end 82 of the outer sidewall 80 along a line of weakness 86. The line of weakness 86 allows the tear strip 32 to be easily removed from the outer sidewall 80 as desired.

As shown in FIG. 5, the outer sidewall 80 is generally parallel to the inner sidewall 66 and defines a receiving cavity 88. The receiving cavity 88 formed between the outer sidewall 80 and the inner sidewall 66 is sized to receive the flexible sealing finger 48 and the latch ring 58, as can be seen in both FIGS. 3 and 4.

Referring back to FIG. 5, the lid 14 further includes a gland seal 90 that extends downward from the connecting portion 74 into the receiving cavity 88. The gland seal 90 is an annular wall that is spaced from the inner sidewall 66 to define an open sealing chamber 92. Further, the gland seal 90 is spaced from the outer sidewall 80 to define a flexing chamber 94. The bottom end 96 of the gland seal 90 is spaced above the locking tab 84 such that the receiving cavity 88 can receive the latch ring 58 between the bottom end 96 of the gland seal 90 and the locking tab 84, as best seen in both FIGS. 3 and 4.

In the embodiment of the invention shown in FIG. 5, the gland seal 90 has a reduced material thickness as compared to the inner sidewall 66 such that the gland seal 90 can be flexed to a small degree upon insertion of the main body 12 into the lid 14. The slight deflection of the gland seal 90 allows for improved sealing between the flexible sealing finger 48 and the inner sidewall 66 and the gland seal 90.

Although the embodiment of the invention shown in the Figures includes the gland seal 90 between the inner sidewall 66 and the outer sidewall 80, it is contemplated that the gland seal 90 could be eliminated in alternate embodiments. In such a configuration, the thickness of the outer sidewall 80 could be expanded above the locking tab 84 to create the sealing chamber 92. In such an embodiment, the sealing chamber 92 would have a much more rigid dimension as compared to the embodiments shown in FIG. 5 that includes the gland seal 90.

As can best be seen in FIG. 4, the flexing chamber 94 is partially filled at several locations by a plastic material that defines a support rib 98. A series of support ribs 98 are spaced along the circumference of the flexing chamber 94 to provide support and stability for the gland seal 90.

Referring back to FIG. 5, the sealing chamber 92 has a uniform width around the entire circumference of the lid 14 that is defined by the distance between the outer surface 100 of the inner sidewall 66 and the inner surface 102 formed as part of the gland seal 90. The width of the sealing chamber 92 is selected to be slightly less than the width W of the flexible sealing finger 48 shown in FIG. 6. Thus, when the lid 14 is pressed onto the main body 12, the flexible sealing finger 48 pivots as shown by arrow 56 in FIG. 6. Upon rotation, the first sealing protrusion 50 is pressed into contact with the inner surface 102 of the gland seal 90 while the second sealing protrusion 52 is held into sealing contact with the outer surface 100 of the inner sidewall 66. The pivoting rotation of the flexible sealing finger 48 about the flexible neck 54 allows the flexible finger 48 to create at least two points of contact between the flexible sealing finger 48 and the inner sidewall 66 and gland seal 90.

Referring now to FIGS. 3 and 4, when the lid 14 is installed onto the main body 12, the flexible sealing finger 48 is received within the sealing chamber 92 formed between the gland seal 90 and the inner sidewall 66 of the lid 14. As described with reference to FIG. 6, the flexible finger 48 rotates to create a plurality of ring contact seals with the lid, as previously described.

As the lid 14 is pressed downward onto the main body 12, the latch ring 58 deflects downward and inward and the outer sidewall 80 deflects outward until the outer end 60 of the latch ring 58 passes over the locking tab 84. Once the outer end 60 of the latch ring 58 passes over the locking tab 84, the outer end 60 is retained by a latching shoulder 104 formed as part of the locking tab 84. The latching shoulder 104 prevents the latch ring 58 from leaving the receiving cavity 88 unless the outer sidewall 80 is pulled outward. Further, the interaction between the latch ring 58 and the locking tab 84 holds the flexible sealing finger 48 within the sealing chamber 92 to insure the multiple sealing points between the flexible sealing finger 48 and the gland seal 90 and inner sidewall 66.

Once the lid 14 has been installed onto the main body 12, the tear strip 32 can be separated from the outer sidewall 80. Once the tear strip 32 has been removed, each of the individual locking sections 28 (FIG. 1) can be pulled outward and upward to release the interaction between the latch ring 58 and the locking tab 84 (FIG. 4).

Referring back to FIG. 3, when the lid 14 is installed onto the main body 12, the generally planar outer surface 100 of the inner sidewall 66 contacts the inner surface 36 of the container wall 16 over the entire length of the inner sidewall 66 from a junction point 106 to the flexible neck 54 of the sealing finger 48. The contact between the inner sidewall 66 and the container sidewall 16 limits the amount of liquid that can become entrapped between the lid 14 and the main body 12. When the plastic container 10 is used with paint or other material that hardens when it dries, the contact between the inner sidewall 66 and the container sidewall 16 prevents liquid from becoming entrapped between the lid and main body, thereby preventing the liquid from entering between the lid and main body, drying and falling back into the storage supply within the container.

Although the embodiment of the invention shown and described in the Figures is described as being formed from a plastic material having a size to store and contain five gallons of a liquid, it is contemplated that various other materials could be utilized and the container could be formed of varying sizes.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A plastic container comprising:

a generally cylindrical main body having an open top end defined by a circumferential lip;

a flexible sealing finger formed along the circumferential lip of the main body, wherein the flexible sealing finger has a width extending between a first sealing protrusion and a second sealing protrusion, the flexible sealing finger being joined to the container sidewall by a flexible neck such that the flexible sealing finger is pivotable relative to the container sidewall; and a lid adapted to be received on the open top end of the main body, the lid comprising:

a top wall connected to an annular inner sidewall;

an outer sidewall parallel to and joined to the inner sidewall by a connector portion to define an annular receiving cavity therebetween; and a gland seal extending from the connector portion and positioned between the inner sidewall and the outer sidewall, the gland seal defining a sealing chamber with the inner sidewall, the sealing chamber having a width less than the width of the flexible sealing finger such that the flexible sealing finger pivots about the flexible neck when the flexible sealing finger is received within the sealing chamber such that the first sealing protrusion engages the gland seal and the second sealing protrusion engages the outer surface of the container sidewall.

2. The plastic container of claim 1 wherein the main body includes a container sidewall having an outer surface and an inner surface, wherein the first sealing protrusion extends past the outer surface and the second sealing protrusion extends past the inner surface.

3. The plastic container of claim 1 wherein the gland seal is spaced from the outer sidewall to define a flexing chamber therebetween.

4. The plastic container of claim 3 further comprising a plurality of strengthening ribs formed between the gland seal and the outer wall within the flexing chamber.

5. The plastic container of claim 1 wherein the gland seal is flexible such that the gland seal deflects when the flexible sealing finger is received within the sealing chamber.

6. A plastic container comprising:

a generally cylindrical main body defined by a cylindrical container sidewall and having an open top end defined by a circumferential lip;

a flexible sealing finger formed around the circumferential lip of the main body, wherein the flexible sealing finger has a width extending between a first sealing protrusion and a second sealing protrusion;

a lid adapted to be received on the open top end of the main body, the lid comprising an inner sidewall and an outer sidewall joined to each other by a connector portion to define a sealing chamber sized to receive the flexible sealing finger, wherein the width of the sealing chamber is less than the width of the flexible sealing finger;

a locking tab formed on the outer sidewall of the lid;

an annular latch ring extending from the container wall, wherein the annular latch ring engages the locking tab when the lid is received on the main body; and a tear strip formed on the outer sidewall of the lid, the tear strip being removably attached to the locking tab.

7. The plastic container of claim 6 wherein the annular latch ring extends from an outer surface of the container sidewall at approximately a 45° angle.

8. The plastic container of claim 6 wherein the locking tab includes a latching shoulder that receives an outer end of the latch ring.

9. The plastic container of claim 6 wherein the first sealing protrusion extends past an outer surface of the container sidewall and the second sealing protrusion extends past an inner surface of the container sidewall.

10. A plastic container comprising:

a generally cylindrical main body defined by a container sidewall and having an open top end defined by a circumferential lip;

a flexible sealing finger formed along the circumferential lip of the main body;

a lid adapted to be received on the open top end of the main body, the lid comprising:

a top wall connected to a circumferential inner sidewall;

an outer sidewall parallel to and spaced from the inner sidewall by a connector portion to define an annular receiving cavity;

a gland seal extending from the connector portion between the inner sidewall and the outer sidewall, the gland seal defining a flexing chamber with the outer sidewall and a sealing chamber with the inner sidewall, wherein a width of the sealing chamber is less than a width of the flexible sealing finger such that the gland seal deflects into the flexing chamber when the sealing chamber receives the flexible sealing finger of the main body;

a locking tab formed on the outer sidewall of the lid; and an annular latch ring extending from the container sidewall, wherein the annular latch ring engages the locking tab when the lid is received on the main body.

11. The plastic container of claim 10 wherein the flexible sealing finger has a width extending between a first sealing protrusion and a second sealing protrusion, wherein the width of the sealing chamber is less than the width of the flexible sealing ring.

12. The plastic container of claim 11 wherein the first sealing protrusion extends past an outer surface of the cylindrical sidewall and the second sealing protrusion extends past an inner surface of the cylindrical sidewall.

13. The plastic container of claim 12 wherein the flexible sealing finger is joined to the container sidewall by a flexible neck such that the flexible sealing finger is pivotable relative to the container sidewall.

14. The plastic container of claim 10 further comprising a tear strip formed on the outer sidewall of the lid, the tear strip being removably attached to the locking tab.

15. The plastic container of claim 10 wherein the locking tab includes a latching shoulder that receives an outer end of the latch ring.

16. A plastic container comprising:

a generally cylindrical main body having an open top end defined by a circumferential lip;

a flexible sealing finger formed along the circumferential lip of the main body, wherein the flexible sealing finger has a width extending between a first sealing protrusion and a second sealing protrusion, the flexible sealing finger being joined to the container sidewall by a flexible neck such that the flexible sealing finger is pivotable relative to the container sidewall; and a lid adapted to be received on the open top end of the main body, the lid comprising:

a top wall connected to an annular inner sidewall;

an outer sidewall parallel to and joined to the inner sidewall by a connector portion to define an annular receiving cavity therebetween; and a gland seal extending from the connector portion and positioned between the inner sidewall and the outer sidewall, the gland seal defining a sealing chamber with the inner sidewall and defining a flexing chamber with the outer sidewall, the sealing chamber having a width less than the width of the flexible sealing finger such that the flexible sealing finger pivots about the flexible neck and the gland seal deflects when the flexible sealing finger is received within the sealing chamber.

17. The plastic container of claim 16 further comprising a plurality of strengthening ribs formed between the gland seal and the outer wall within the flexing chamber.

18. The plastic container of claim 16 further comprising:

a locking tab formed on the outer sidewall of the lid; and an annular latch ring extending from a container sidewall, wherein the annular latch ring engages the locking tab when the lid is received on the main body.

19. The plastic container of claim 18 further comprising a tear strip formed on the outer sidewall of the lid, the tear strip being removably attached to the locking tab.

20. The plastic container of claim 18 wherein the locking tab includes a latching shoulder that receives an outer end of the latch ring.

* * * * *